US005351024A

United States Patent [19]

Juds et al.

[11] Patent Number: 5,351,024

[45] Date of Patent: Sep. 27, 1994

[54] ELECTRICAL CONTACTOR AND INTERRUPTER EMPLOYING A ROTARY DISC

[75] Inventors: Mark A. Juds, New Berlin; Bruce C. Beihoff, Wauwatosa; Richard G. Smith, Caledonia; William R. Nelson, Waukesha; Daniel A. Wycklendt, Milwaukee; Peter J. Theisen, West Bend; Jerome K. Hastings, Sussex; Peter K. Moldovan, Cascade, all of Wis.

[73] Assignee: Eaton Corporation, Cleveland, Ohio

[21] Appl. No.: 27,972

[22] Filed: Mar. 8, 1993

[51] Int. Cl.[5] ..... H01H 75/00

[52] U.S. Cl. ..... 335/16; 335/147; 335/195; 200/147 R

[58] Field of Search ..... 335/16, 147, 195; 200/147 R, 28

[56] References Cited

U.S. PATENT DOCUMENTS 2,056,282 10/1936 Lanyon ..... 200/28

*Primary Examiner*—Lincoln Donovan

*Attorney, Agent, or Firm*—Loren H. Uthoff, Jr.

[57] ABSTRACT

An electrical power switching device employing a rotary disc driven by an actuation means whose position is selected by a control means where disc contacts engage and disengage stationary contacts where the stationary contacts are deflected away from the disc contacts by separation ramps thereby opening the current path and an arc plate is used on the disc to control arc energy. A pair of interrupter contacts are placed in series with the rotary disc contacts where abnormally high currents cause the interrupter contacts to separate and open the current path where slot motors and/or arc plates are used to dissipate the damaging electrical arcs as the contacts make and break.

14 Claims, 3 Drawing Sheets

FIG 2
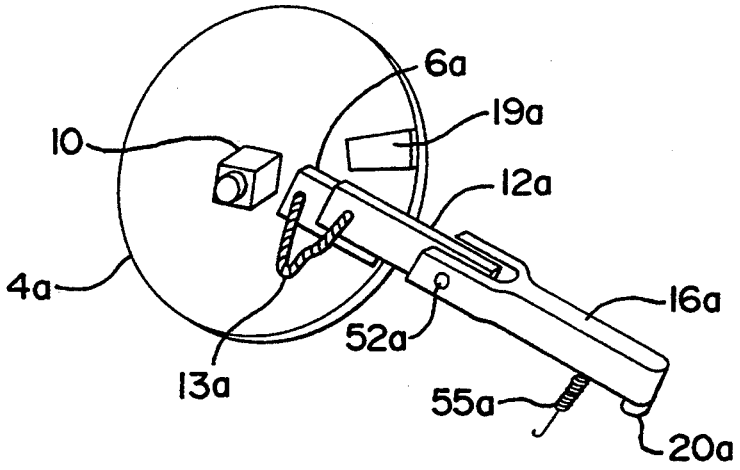
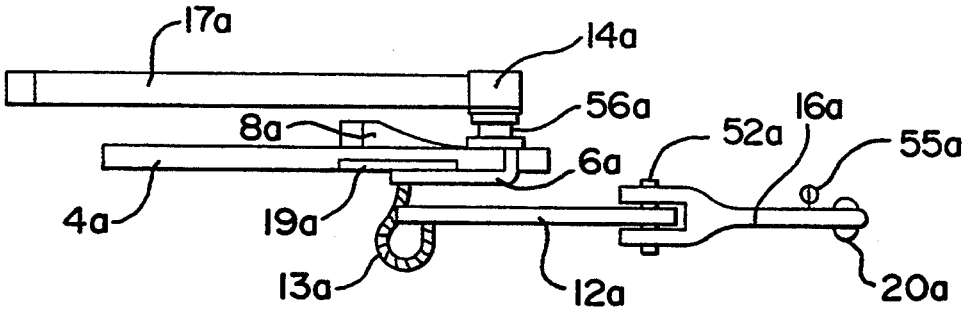
FIG 3

FIG 4
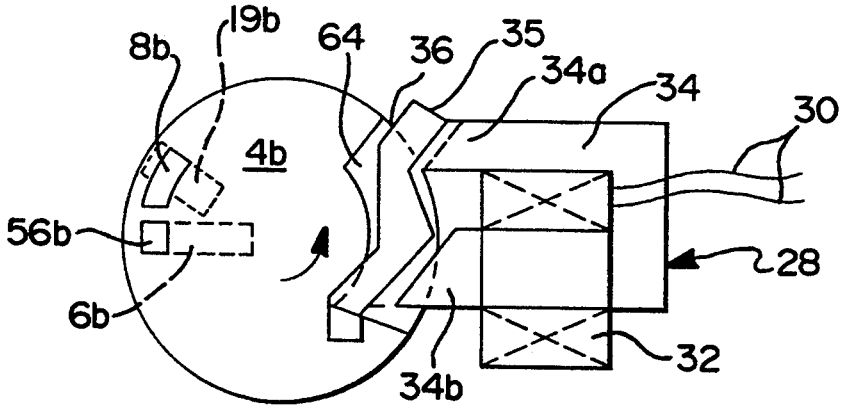
FIG 5
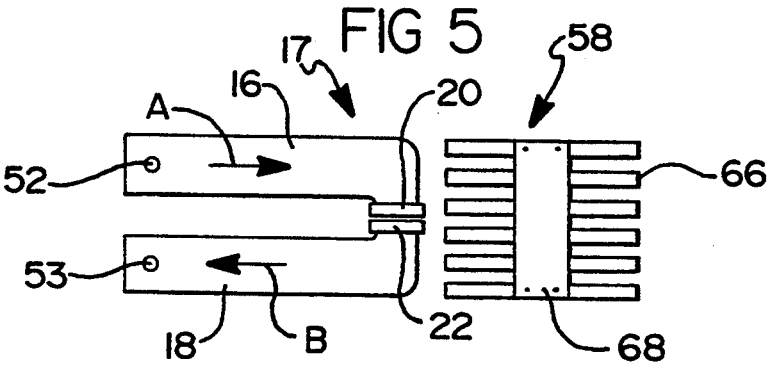
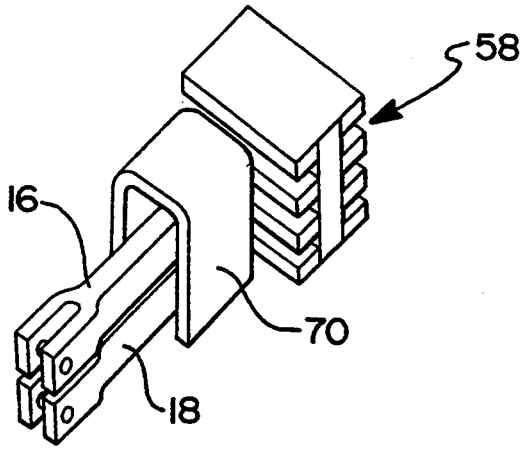
FIG 6

ELECTRICAL CONTACTOR AND INTERRUPTER EMPLOYING A ROTARY DISC

FIELD OF THE INVENTION

This invention relates to an electrical contactor for controlling flow of electrical power to a device such as a motor. More specifically, this invention relates to an electrical contactor where normal electrical power flow can be initiated or terminated using one set of electrical contacts in series with a second set of electrical contacts where the second set of contacts operate as an interrupter to quickly terminate electrical conductivity to the device should abnormal current surges occur.

DESCRIPTION OF THE PRIOR ART

Various types of electrical contact systems are well known in the art and generally function to open or close at least one electrical contact for controlling the flow of electrical power from an electrical supply to some type of electrical or electromechanical device. The purpose of the electrical contactor is to allow for either manual or automatic control of the electrical device so that its operation can be stopped and started either in normal operation or during abnormal operation where the supply of electrical current exceeds some type of desired maximum whereupon the electrical contactor opens and terminates flow of electrical power into the device.

Common prior art methods of accomplishing the initiation or termination of electrical power flow have employed a variety of mechanical mechanisms which are commonly spring loaded to force a pair of electrical contacts together using a force selected to yield a force versus time history to minimize contact bounce and thereby improve the life of the contacting elements. The mechanical mechanism is controlled by operation of a manual switch which is moved to an "on" position or to an "off" position which causes the electrical contactor to close or open. Usually the action of the manual switch is designed to be abrupt with a somewhat high actuation force required to move from the on to the off position or visa versa. Various types of arc suppression devices are used to provide for the dissipation of the electrical energy caused by the arcing between the contacts when the electrical contactor is opened or closed. These include slot motors and arc chutes which allow for a path of electrical energy flow auxiliary to the contacts for movement and dissipation of the arc energy away from the contacting elements.

With the recent expansion in use of microprocessors for control of various electrical devices in commercial and industrial environments, it is desirable to provide some type of electrical contactor which can be controlled electronically to provide the switching of high currents into various electrical devices particularly for performing manufacturing or commercial operations. This microprocessor controlled operation precludes the use of a manually thrown on/off switch with its attendant high actuation forces.

It would also be desirable to have an electrical contactor which would provide for the switching of normal currents while also employing a high current interrupter which operates in an expeditious manner when exceedingly high currents are encountered by rapidly opening a set of contacts in series with those of the normal current carrying contactor to prevent damage to the electrical device, the contactor, or the power supply. The prior art shows fuse links being used in this capacity where a small section of metal having a designed cross-section is inserted in series with the power connectors where a large surge in electrical current causes this piece of metal to melt and break the electrical connection before damage to the other components can occur. The prior art also discloses other types of non-fused interrupters, however, they are not combined with an electronically controlled rotary action switching contactor which would be desirable for controlling electrical devices such as a motor.

SUMMARY OF THE INVENTION

The present invention allows for the use of an electronically (versus manual) controlled actuation device especially for remote control by an electrical control signal which acts upon one or more rotary discs with electrical contacts contained thereon to make or break an electronic power circuit for connecting a power supply to some form of electrical device such as a motor. In addition, in series between the electrical power supply and the electrical contacts associated with the rotary disc is one or more interrupter contact pairs which serve to rapidly open the electrical circuit should an abnormal current event occur, thereby preventing damage to any of the elements of the electrical device or the contactor or the power supply. With the use of the present invention, a microprocessor can be used to control the flow of electrical current from a power supply to one or more electrical devices where the actuation of the electrical contactor is effectuated by a signal from the microprocessor based controller to the electronic actuator as opposed to prior art methods of manual actuation.

With the use of the present invention, normal operating currents can be electronically switched from an "on" to an "off" position or visa versa with good contact life by using a rotary disc having at least one contact which works in conjunction with a contact ramp which when the electrical circuit is to be opened, one of the electrical contacts is engaged by the ramp thereby forcing the spring loading contact away from the disc contact.

The interrupter contacts make use of the electro-magnetic forces generated by the current flow to force the contacts apart thereby opposing and overcoming a spring preload which normally holds the contact pair together. In this manner, operation to open the electrical circuit upon introduction of an abnormally high supply current is rapidly effectuated and works in conjunction with the slower reacting rotary disc which is then opened by de-energizing the actuator to prevent the flow of electrical current to the electrical device.

A variety of arc suppression devices can be incorporated and used with the present invention to dissipate the electrical arc generated when the contacts of the interrupter or the rotary disc are opened and closed. The purpose of the arc suppression device is to improve operation of the making and breaking of the contacts during the making or breaking by dissipating the arc generated when the conducting surfaces touch and bounce upon closure or opening away from the contacts into the arc suppressor. The present invention also discloses a new method of arc suppression wherein a section of steel is embedded in the rotary disc in close proximity to the disc contact which absorbs the electrical energy generated by the arc when the disc contact engages the stationary contact.

One provision of the present invention is to provide a method of electronically controlling a contactor interrupter for the switching of electrical power from an electrical power supply to an electrical device.

Another provision of the present invention is to provide for a method of separating a moving contact from a stationary contact for more reliable switching with improved operation.

Another provision of the present invention is to provide for the switching of a moving contact from a stationary contact for improved life.

Another provision of the present invention is to provide for the rapid interruption of electrical power flow when an abnormally high current is encountered.

Another provision of the present invention is to provide for the interruption of electrical power flow when an abnormally high current is encountered by opening a pair of interruption contacts and simultaneously de-energizing an actuator to open a second electrical contact pair controlled by the position of a rotary disc.

Still another provision of the present invention is to provide for the suppression of the arc generated when a moving contact engages a stationary contact where the moving contact is mounted on a rotary disc.

BRIEF DESCRIPTION OF THE DRAWINGS

FIG. 2 is a perspective view of the rotary disc and one side of the interrupter contact of the present invention;

FIG. 3 is a top elevational view of the rotary disc, the stationary contact and the interrupter contact of the present invention;

FIG. 4 is a side elevational view of the rotary disc and the actuator of the present invention;

FIG. 5 is a side elevational view of the interrupter contact and the arc suppression plates of the present invention; and FIG. 6 is a perspective view of the interrupter contacts coupled with an arc suppression system consisting of a slot motor and a plurality of arc suppression plates.

DETAILED DESCRIPTION OF THE PREFERRED EMBODIMENTS

Figure 1:
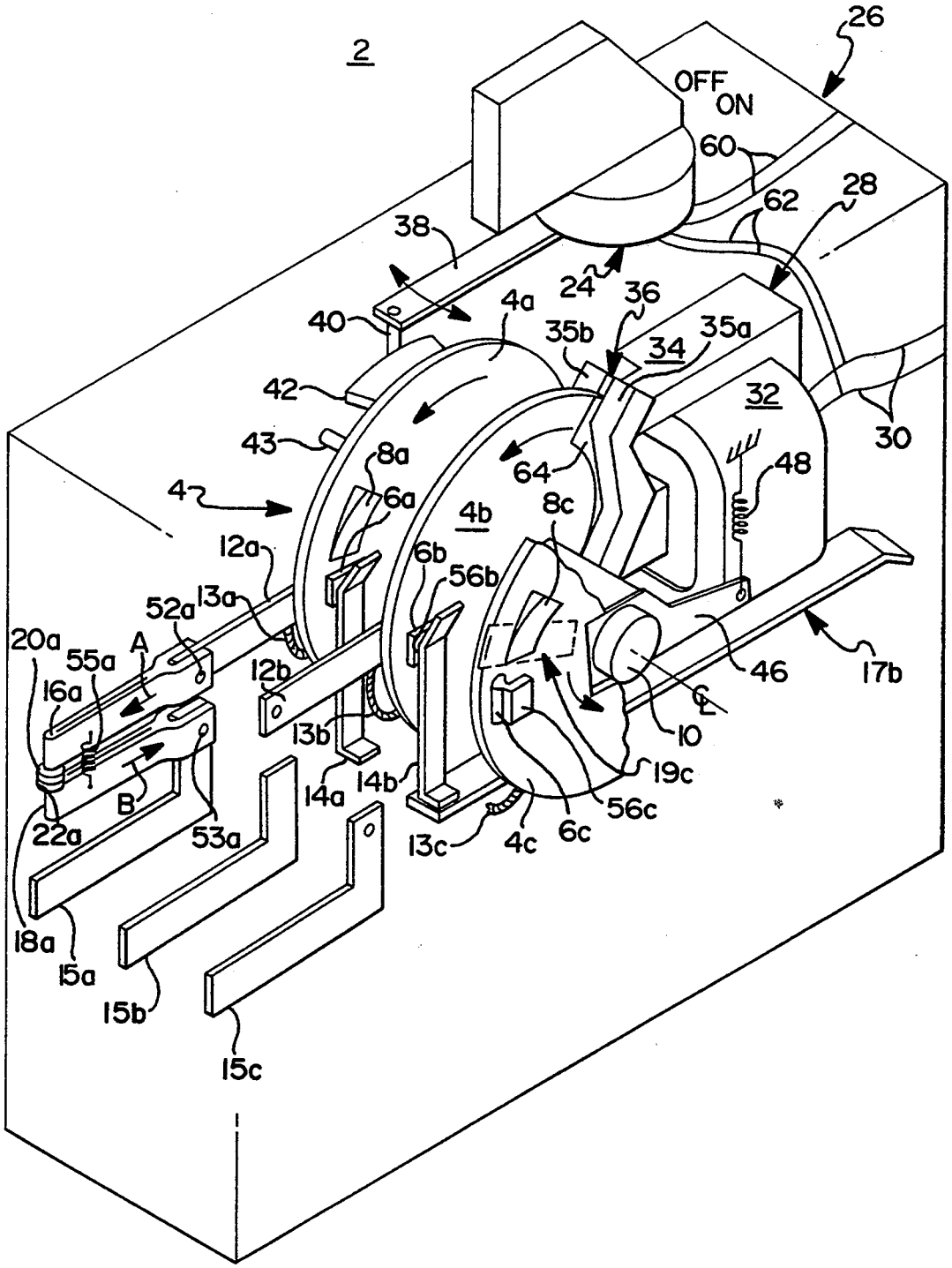
FIG. 1 is an exploded perspective view of the electrical contactor interrupter of the present invention.

Now referring to FIG. 1 of the drawings, an exploded perspective view of the electrical contactor system 2 of the present invention is shown. An electrical power supply (not shown) supplies power to the electrical contactor system 2 which controls the flow of power through the action of a rotary disc 4 which contains one or more disc contacts 6*a*, 6*b*, and 6*c* which are positioned to engage and disengage a like number of stationary contacts 14*a*, 14*b*, and 14*c* (where 14*c* is not shown in FIG. 1). The rotary discs 4*a*, 4*b*, and 4*c* are supported in a rotary manner to the case 26 by way of a disc shaft 10 which is supported to the case 26 by way of some bearing means which allows the rotary disc 4 to rotate relative to the case 26. The electrical current flow from the electrical power supply flows through one or more base contact extensions 17*a*, 17*b*, and 17*c* (with 17*c* not being shown), where the stationary contacts 14*a*, 14*b*, and 14*c* are connected to the base contact extensions 17*a*, 17*b*, and 17*c* respectively for conduction of, for example, a three-phase electrical current from a three-phase electrical power supply through the stationary contacts 14 into the disc contacts 6*a*, 6*b*, and 6*c* where the making and breaking of the contacts is controlled by the operation of the rotary discs 4*a*, 4*b*, and 4*c*.

The electrical current then flows from the disc contact 6*a*, 6*b*, and 6*c* into one or more disc contact extensions 12*a*, 12*b*, and 12*c* where the disc contacts 6*a*, 6*b*, and 6*c* are connected to the disc contact extensions 12*a*, 12*b*, and 12*c* through a like number of contact connectors 13*a*, 13*b*, and 13*c*. The disc contact extensions 12*a*, 12*b*, and 12*c* (where 12*c* is not shown in FIG. 1) are then connected to the extension breaker arms 16*a*, 16*b*, and 16*c* respectively where extension breaker arm 16*b* and 16*c* are not shown in FIG. 1 but are similar in structure to extension breaker arm 16*a*. The electrical current then flows from the extension breaker arm 16*a* into a contact pad 20*a*, only one of the contacts will be discussed from this point on, which is attached and electrically connected to the extension breaker 16*a*. The extension breaker arm 16*a* is connected to the disc contact extension 12*a* by way of an attachment means which allows the extension breaker arm to rotate relative to the disc contact extension 12*a*.

The contact pad 20*a* is generally in alignment with contact pad 22*a* both of which are made out of a material which allows for the conduction of relatively high power levels of electric current to flow therebetween with a minimal amount of damage in high conductivity value. The contact pad 22*a* is electrically and mechanically mounted to an extension contact 18*a* (which is similar in nature to the extension breaker arm 16*a*) and which is mounted to the stationary base contact 15*a* in a manner which allows it to rotate relative thereto. The stationary base contact 15*a* is then electrically connected to some form of electrical device to which the electrical power supply is electrically connected thereto. The contactor system 2 functions as an electrical current contactor and interrupter which serves to connect the electrical power supply to the electrical device under normal current flow conditions and to interrupt the current flow should abnormal conditions be encountered.

The contactor system 2 of the present invention is surrounded by a suitable case 26 to which a locking switch 24 is mounted. The function of the locking switch 24 is to allow for operation or non-operation of the contactor system 2 of the present invention where the electrical switch 24 is a portion which rotates relative to said case 26 and extends and supports a switch lever 38 which in turn supports a switch pin 40 which functions to lock the rotary disc in a position such that the disc contacts 6*a*, 6*b*, and 6*c* are separated electrically and mechanically from the stationary contacts 14*a*, 14*b*, and 14*c* respectively by engaging a disc locking plate 42 when the disc 14 is rotated fully counterclockwise by a return spring 48 and electrical current does not flow through the contactor system 2. The disc locking plate 42 is mechanically attached to the rotary disc 4*a* and protrudes to contact both the disc stop pin 43 and the switch pin 40 when the locking switch 24 is in the off position. When the locking switch 24 is in the on position, the switch pin 40 does not engage the disc locking plate 42 and the rotary disc 4 is free to move in a rotary fashion until stopped when rotated in a counterclockwise direction by the disc stop pin 43 against the disc locking plate 42.

The disc stop pin 43 is positioned and fastened to the case 26 in a manner to stop the rotation of the rotary disc 4*a*, 4*b*, and 4*c* when the rotary disc 4 is not in a position to allow current to flow through the disc contact 6 (i.e. contacts are open). References to rotary disc 4 and disc contact 6 are to be interpreted as references to one or all of the rotary discs 4a, 4b and 4c and disc contacts 6a, 6b and 6c respectively.

The rotary disc 4 is held in position by action of the return spring 48 having one end attached to the case 26 and a second end attached to a lever arm 46 which is fastened to the disc shaft 10 and acts to force the rotary disc 4 against and in a direction such that the disc locking plate contacts the disc stop pin 43 when no forces are generated by the actuator 28. The actuator 28 is connected to some form of control unit such as a microprocessor by the actuator control leads 30 where, when the microprocessor or other control means seeks to interrupt the power flow from the electrical power supply to the electrical device, the actuator 28 is supplied with electrical power through the actuator control leads 30 which flows into an actuator coil 32. The current flow into the actuator coil 32 sets up an electromagnetic field which flows through the actuator frame 34 which is made of a magnetically conductive material well known in the prior art thereby producing a relatively high level of magnetic flux in the actuator air gap 36. The rotary disc 4 is positioned such that, for example, one of the rotary discs such as disc 4b engages the actuator air gap 36. The rotary disc 4b contains a disc actuator element 64 which is commonly a piece of magnetically conductive steel which is more clearly shown in FIG. 4. The electro-magnetic field in the actuator air gap 36 acts upon the disc actuator element 64 thereby drawing the disc actuator element 64 (shown in FIG. 4 only) into the actuator air gap 36 which rotates the rotary disc on the disc shaft 10 in a clockwise direction. FIG. 1 shows the contactor system 2 with the actuator 28 in an energized state where it has drawn the disc actuator element 64 has been drawn into the air gap 36 and the return spring 48 is in a stretched state. Electrical current is allowed to flow through the contactor system 2 into any type of electrical device connected to the stationary base contacts 15.

When the locking switch 24 is placed in the on position, the electrical control power leads 60 which are connected to a separate source of electrical energy routes that electrical energy into the actuator coil 32 by way of switch control leads 62 such that the actuator 28 is energized and rotates the rotary discs 4a, 4b, and 4c into a position to make the electrical connection from the disc contact 6a, 6b, and 6c to the stationary contacts 14a, 14b, and 14c respectively.

In FIG. 1, the return spring 48 has one end attached to an extension arm 46 which acts as a lever on the disc shaft 10 with a second end grounded to the housing 26 such that a torque is introduced into the rotary disc 4 which is in a direction opposite to the rotary force generated by the actuator 28. In this manner, the contactor system 2, without electrical actuation of the contactor 28, goes to a position due to the return spring 48 where electricity is not conducted from the power supply through the contactor system to the electrical device that is to be powered and controlled. The return spring 48 can take on many different forms such as a clock spring acting upon one of the rotary discs 4 or the disc shaft 10 and reacting against a stationary member such as the housing 26. Another alternative for the return spring 48 would be to attach a spring directly to the rotary disc 4 with another attachment to the housing 26.

The return spring 48 acts upon the lever arm 46 to hold the rotary disc 4a, 4b, and 4c in a direction opposite to that induced by the actuator 28 where the rotation of the rotary disc 4a is stopped by the disc stop pin 43 acting upon the disc locking plate 42.

Reference is made to elements associated with disc 4a although the description applies to discs 4b and 4c in a similar manner. Any number of rotary discs 4 including rotary discs 4a, 4b and 4c and their associated disc contacts 6a, 6b and 6c could be utilized to control separate electrical current flow paths.

Now referring to FIG. 2, a perspective view of the rotary disc 4a and one side of the current interrupter is shown. Supporting the rotary disc 4a to the case 26 is the disc shaft 10 about which the rotary disc 4a is rotated by the actuator 28 (see FIG. 1) operating through electro-magnetics on the drive actuator elements 64 (see FIG. 4). Mounted to the rotary disc 4a is the disc contact 6a which extends through an opening in the rotary disc 4a forming the support for the disc contact pad 56a shown in FIG. 3. The disc contact 6a is electrically attached to the disc contact extension 12a through a braided wire connector 13a such that the electrical current is transferred from the disc contact pad 56a to the disc contact 6a which rotates with the rotary disc 4a and then transfers to the contact extension 12a by way of the contact connector 13a where the contact connector 13a allows for the relative motion between the disc contact 6a and the disc contact extension 12a. The disc contact extension 12a is mounted to the case 26 and extends and is attached to the extension breaker arm 16a which is part of the interrupter contact system by way of the upper contact pivot 52a which can be a pin which is inserted through holes drilled in the extension breaker arm 16a and the disc contact extension 12a. The extension breaker arm 16a is formed to lightly press against the disc contact extension 12a around the pivot point to provide a solid electrical contact path. As an alternative, a braided wire could be used to connect the two pieces. The contact spring 55a is attached at one end to the extension breaker 16a with the other end attached to the extension contact 18a as shown in FIG. 1 and electrically insulated at at least one attachment point. The function of the contact spring 55a is to force the extension breaker arm 16a against the extension breaker arm 18a so that current flows from the contact pad 20a into contact pad 22a until an abnormally high current passes whereupon the extension breaker arm 16a and the extension breaker arm 18a will separate against the force of the contact spring 55a due to the electrical forces generated described infra.

The extension breaker arm 16a is held against the stationary breaker arm 18a by a spring 55a such that the contact pad 20a is forced against the contact pad 22a providing a path for electrical current flow therebetween. The contact spring 55a can be a spring device such as a coil spring as shown in FIG. 1 or a clock spring or some other form of spring device allowing the extension breaker arm 16a to be drawn against the stationary breaker arm 18a while allowing for the free pivot of either the extension breaker arm 16a and the stationary breaker arm 18a on their respective conductors being disc contact extension 12a and the stationary base contact 15a respectively. The stationary breaker arm 18a can be made to pivot on the stationary base contact 15a or it can be fixed to the stationary base contact. If the stationary breaker arm 18a is free to rotate, then the extension breaker arm 16a can be fixed to the disc contact extension 12*a*. All references to elements having a suffix of "a" apply in a similar manner to those elements having a suffix of "b" or "c" or any other number of contact pairs.

FIG. 2 also shows an arc disc plate 19*a* which is embedded or attached to the rotary disc 4*a* in a location approximately opposite that of the narrowest leading edge of the contact ramp 8*a* and extending into the contact ramp 8*a* and extending toward the center of the rotary disc 4*a*. The functional purpose of the arc disc plate 19*a*, which is usually made of an electrically conductive steel material, is to concentrate the local magnetic field generated by the electrical arc which will cause the arc to move off of the contacts when the contacts are making or breaking the electrical current flow thereby improving the life and function of the contacting elements, specifically the disc contact pad 56*a* and the stationary contact 14*a*.

Now referring to FIG. 3, a top view of the rotary disc 4*a* of the present invention is shown along with the base contact extension 17*a* which is a conductive strip of material connected to the electrical power supply (not shown) and then attached to the stationary contact 14*a* which allows current to pass into the disc contact pad 56*a* and into the disc contact 6*a* where it passes into the interrupter contact section formed by the disc contact extension 12*a* and the extension breaker arm 16*a*. More clearly shown in FIG. 3 is the contact ramp 8*a* which functions to separate the stationary contact 14*a* from the disc contact 6*a* to interrupt the current flow through the electrical device 2 from the power supply into the electrical device as the rotary disc 4 is caused to rotate by the return spring 48.

Now referring to FIG. 4, a side view of the rotary disc 4*b* engaging and partially occupying the actuator air gap 36 is shown. The rotary disc 4*b*, carrying the disc contact 6*b*, is rotated in a counterclockwise direction by magnetic action of the actuator 28 on the disc actuator element 64 which is attached to or embedded in the rotary disc 4*b*. The rotary disc 4 (where rotary disc 4 refers to rotary discs 4*a*, 4*b*, and 4*c* or any number of similar elements) is made of a material having insulating qualities with respect to the flow of electrical current. A commonly used material for this application would be a fiberglass, ceramic or phenolic or other moldable polymers which could be molded or cut to the appropriate shape. Generally, conductors such as the base contact extension 17*a*, the stationary contact 14*a*, the disc contact 6*a*, the disc contact extension 12*a*, the extension breaker arm 16*a*, the stationary breaker arm 18*a*, and the stationary base contact 15*a* could all be made of a highly electrically conductive material such as copper or any other material having similar characteristics. The disc contact pad 56*a*, the contact pad 20*a*, and the contact pad 22*a* would be of a special contacting highly conductive contact material which would withstand arcing and high currents such as silver based mixtures of materials. In spite of the reference to the rotary disc 4*b*, the actuator 28 can be installed to react with all of the rotary discs 4*a*, 4*b* or 4*c* in a similar manner assuming a magnetically conductive disc actuator element 64 is present on the rotary disc 4*a*, 4*b* or 4*c*. Elements 4*a*, 17*a*, 14*a*, 56*a*, 8*a*, 6*a*, 12*a*, 16*a*, 20*a*, 22*a*, 18*a* and 15*a* are duplicated for each rotary disc 4 that is used to control the flow of electrical current. Any reference to one implies a similar reference to a second rotary disc 4.

The actuator 28 is made up of an actuator frame 34 which can be of laminated magnetic steel in the shape of a "U" with the ends attached to the frame cap 35 where the frame cap 35 is slotted along with a portion of the actuator frame 34 to allow for the portion of the rotary disc 4*b* to pass through, specifically, the magnetic field generated by the actuator 28 acts to draw the disc actuator element 64 which is commonly made out of a magnetic steel material so that it is drawn into and fills the actuator air gap 36 thereby causing the rotary disc 4*b* to rotate against the return spring 48 causing the disc contact 6*b* to engage the stationary contact 14. The field is generated in the actuator frame 34 by introduction of a field electrical current into the actuator control leads 30 which continue and encircle to form a multiplicity of turns surrounding one leg of the actuator frame 34 to form an actuator coil 32.

The frame cap 35 is split into a left cap 35*a* and a right cap 35*b* (see FIG. 1). The left cap 35*a* is attached to the upper frame 34*a* and the right cap 35*b* is attached to the lower frame 34*b*.

Thus, in operation, the contactor system 2 uses a spring to force the rotary disc 4 into a position where the electrical current is not allowed to flow from the power supply through the stationary contact 14 into the disc contact pad 56, into the disc contact 6, into the contact connector 13 into the disc contact extension 12, into the extension breaker arm 16, then into the stationary breaker arm 18 and finally into the stationary base contact which is connected to the electrical device that receives the electrical power from the power supply. When the actuator 28 is energized, the rotary disc 4 rotates to that position shown in FIG. 4 and electrical current is allowed to flow through the contactor system 2 into the electrical device (not shown).

Now referring to FIG. 5, a side view of the interrupter contacts 17 made up of the extension breaker arm 16 and the stationary breaker arm 18 are shown adjacent to the arc suppressor 58 (not shown in FIG. 1). The arc suppressor 58 is made up of a plurality of metal arc plates 66, substantially parallel to one another and attached to and supported by the plate support 68. The function of the arc suppressor 58 is to improve the breaking function by transferring the electrical energy formed between the contact pads 20 and 22 as the electrical interruption is accomplished when abnormally high currents pass through the interrupter contacts 17. By drawing the electrical energy into the arc suppressor 58, the life of the contact pads 20 and 22 is increased and their function improved thereby.

The direction of the flow of electrical current through the interrupter assembly made up of the extension breaker arm 16 and stationary breaker arm 18 generates a repulsion force that tends to open the contact pads 20 and 22 from one another thereby interrupting flow of electrical energy from the power supply to the contactor system 2. Specifically, the direction of current flow in extension breaker arm 16 is illustrated by the arrow labeled as "A" which then flows through the contact pad 20 into the contact pad 22 reversing direction and in the stationary breaker arm 18 and labeled as and in the direction of arrow "B" opposing the direction of current flow identified by "A". The force generated is similar in effect to that generated in what is called in the art a "turn back conductor" where current flow is reversed in direction through a conductor produces an electro-magnetic repulsion force in a direction tending to open contacting surfaces attached thereto overcoming the spring 55.

An alternative arrangement for arc suppression is shown in FIG. 6 where again the extension breaker arm 16 is shown mated with the stationary breaker arm 18 where the contact pads 20 and 22 reside within a "U" shaped section of material, usually steel, which makes what is known in the art as a slot motor 70. The slot motor 70 functions in a similar manner to the arc suppressor 58 in that the electrical energy generated in the form of an arc is suppressed when the contact pads 20 and 22 break the electrical circuit from the power supply to the electrical device 2. The slot motor 70 can be used as a single arc control element or, in the alternative as illustrated in FIG. 6, an arc suppressor 58 can be used as a second suppression element acting in conjunction with the slot motor 70.

All references made herein to the elements identified by "a", or "b", or "c" (or without subscript) are to be construed in a identical manner where any number of similar elements can be added to control additional electrical circuits in the same manner as disclosed herein. Also, there are many alternative actuators that could be used to impart a rotary motion to the rotary disc 4 with a slotted frame having an electro-magnetic field generated by an electrical coil being only one such type of actuation device.

Although the present invention is herein described with respect to the illustrated embodiments, it will be understood that the invention is capable of modification and variation, which will be encompassed by the scope of the following claims.

What is claimed is:

1. An electrical contactor for controlling the flow of electrical power comprising:

a case for enclosing said electrical contactor;

control means for signalling said electric contactor to commence and terminate the conduction of electrical power;

a disc rotatably mounted on said frame member formed of an electrically insulating material;

a first electrical disc contact affixed to said disc;

actuation means for rotating said disc upon receiving an energization signal from said control means;

spring means for rotating said disc in a direction opposing that produced by energization of said actuation means;

a ramp affixed to said disc relatively close to said electrical disc contact, said ramp having a thin first edge and a thicker second edge, said thin first edge being adjacent to said first electrical disc contact and said ramp extending in a substantially radial direction opposite to the direction of rotation of said disc when rotated by the energization of said actuation means;

a second electrical disc contact having a first end to be connected to a source of electrical power and a second end having a disc contact portion directly opposed to said first electrical disc contact when said actuation means is energized and where said disc contact portion encounters said ramp being forced away from said disc thereby when said actuation means is non-energized; and a circuit protection contact having a first arm rotatably mounted to said case and electrically connected to said first electrical disc contact said first arm having a first electrical contact portion and a second arm rotatably mounted to said case having a second electrical contact portion loaded against said first arm where said first arm electrical portion contacts said second arm electrical portion allowing electrical power to flow therebetween when said electrical power is within the desired operating limit and where said first arm moves away from said second arm against said spring load when said electrical power is at a very high level thereby interrupting the flow of electrical power from said first electrical contact portion to said second electrical contact portion.

2. The electrical contactor of claim 1, wherein said actuation means comprises:

a coil electrically connected to said control means;

a disc actuator element made of a magnetically conducting material embedded in said disc;

a frame member made of a magnetically conducting material having an opening, said frame member being slotted at one end for allowing said disc to pass therethrough and where said coil encircles said frame member generating a magnetic field in said frame member reacting with said disc actuator element generating a rotary torque in said disc.

3. The electrical contactor of claim 1, wherein said first arm is substantially opposed to said second arm.

4. The electrical contactor of claim 1, wherein said disc contains an electrically conductive section positioned approximately opposite to said ramp for dissipation of arc energy.

5. The electrical contactor of claim 1, wherein said disc is spring loaded to rotate in a direction opposing said actuation means.

6. The electrical contactor of claim 1, wherein said first arm is electrically connected to said disc contact by a braided copper wire.

7. The electrical contactor of claim 1, wherein said circuit protection circuit is positioned in relatively close proximity to an arc suppression means.

8. The electrical contactor of claim 6, wherein said arc suppression means comprises a plurality of parallel electrically conducting plates.

9. The electrical contactor of claim 6, wherein said arc suppression means comprises a slot motor formed from a flat section of electrically conductive material to cover said circuit protection contact.

10. The electrical contactor of claim 1, wherein said disc is stopped in rotary position by a locking pin where said locking pin is mounted to said case and extends to engage a disc locking plate where said disc locking plate protrudes and is attached to said disc.

11. The electrical contactor of claim 1, further comprising:

a disc stop pin mounted to said frame;

a locking plate mounted to said disc where said disc stop pin is positioned to engage said locking plate thereby preventing the disc from rotary motion in a given direction.

12. The electrical contactor of claim 9, further comprising:

a locking switch rotatably mounted to said case having an arm member extending therefrom;

a locking pin mounted to said arm member and positioned to engage said locking plate thereby preventing the disc from further rotary motion in a given direction.

13. The electrical contactor of claim 1, wherein said first electrical contacting portion and said second electrical contacting portion are positioned adjacent to a plurality of electrically conductive parallel plates positioned parallel to said first electrical contacting portion and said second electrical contacting portion.

14. The electrical contactor of claim 1, wherein said first electrical contact portion and said second electrical contact portion are partially enclosed within a slot motor comprised of a section of steel.

* * * * *